US006664935B1

(12) United States Patent
Thompson et al.

(10) Patent No.: US 6,664,935 B1
(45) Date of Patent: Dec. 16, 2003

(54) BROAD BAND IMPEDANCE MATCHING DEVICE WITH COUPLED TRANSMISSION LINES

(75) Inventors: William John Thompson, Chandler, AZ (US); Anthony M. Pavio, Paradise Valley, AZ (US); Lei Zhao, Chandler, AZ (US); John C. Estes, Tempe, AZ (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 10/208,961

(22) Filed: Jul. 31, 2002

(51) Int. Cl.[7] ..... H01Q 1/50; H01P 3/02

(52) U.S. Cl. ..... 343/860; 343/864; 333/124; 333/32

(58) Field of Search ..... 343/860, 864, 343/863; 333/124, 32, 34, 246; H01Q 1/50; H01P 3/02

(56) References Cited

U.S. PATENT DOCUMENTS 3,678,418 A * 7/1972 Woodward ..... 333/26
5,093,639 A * 3/1992 Franchi et al. ..... 333/24 R
6,556,099 B2 * 4/2003 Khan et al. ..... 333/34

* cited by examiner

*Primary Examiner*—Hoanganh Le
(74) *Attorney, Agent, or Firm*—William E. Koch

(57) ABSTRACT

A broadband impedance matching integrated circuit apparatus comprising an alternating current ground plane, a direct current ground plane positioned proximate to the alternating current ground plane, a first conductive transmission line positioned a distance from the alternating current and direct current ground planes, a dielectric material layer with a thickness positioned on the first conductive transmission line, a second conductive transmission line positioned on the dielectric material layer wherein the first and second conductive transmission lines are electrically interconnected to behave as an electromagnetically coupled tapped autotransformer.

35 Claims, 3 Drawing Sheets

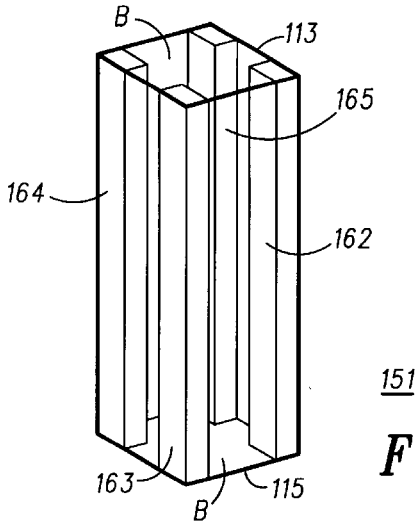
FIG. 3
FIG. 4
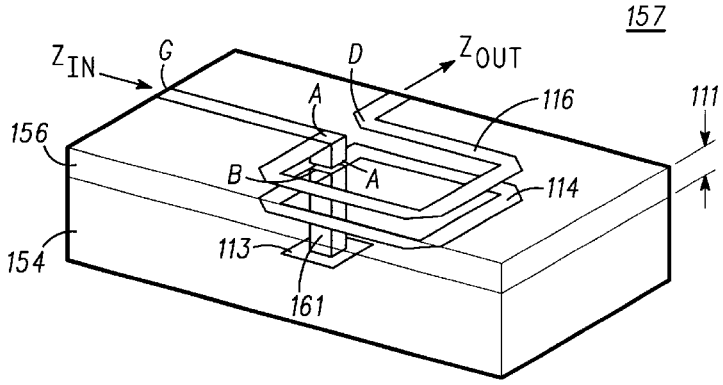
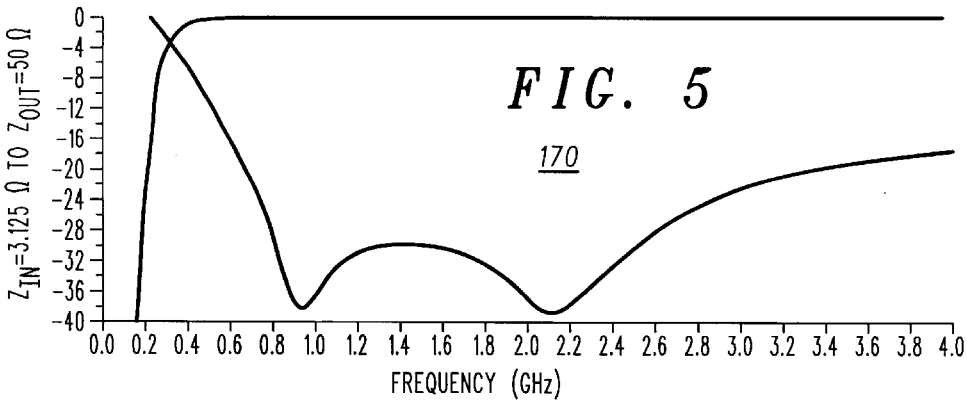
FIG. 5

BROAD BAND IMPEDANCE MATCHING DEVICE WITH COUPLED TRANSMISSION LINES

FIELD OF THE INVENTION

This invention relates to an electronic impedance matching device. More particularly, the present invention relates to microstrip coupled transmission lines used to form electronic impedance transformers on low temperature co-fired ceramics.

BACKGROUND OF THE INVENTION

Impedance matching circuits are used to efficiently transfer energy between electronic circuits, which are electrically connected to each other and have different characteristic impedances. Impedance matching is accomplished by rendering the impedance seen at the output of one circuit equal to the impedance seen at the input of another interconnected circuit. To this end, it is necessary to match source impedances and load impedances of the circuits. The matching circuit is located between the output of the original source circuit and the input of the original load impedance. The matching circuit acts to transform the original unmatched interface into two matched interfaces. When the impedances are matched, maximum power can be provided from the power source to the load.

The most common form of broadband impedance matching network employs wire wound inductors sharing a common magnetic path that incorporates special ferromagnetic magnetic materials to greatly increase the mutual magnetic coupling between the inductors. The physical magnetic material path is commonly called a magnetic core. The best of these magnetic materials can increase the magnetic coupling by more than 10,000:1 relative to air or other non-ferromagnetic materials. These impedance matching devices, commonly called transformers, provide ratiometrically broadband results at low power line and audio frequencies. The broadband performance depends on the magnetic coupling enhancement provided by the special high permeability magnetic materials. At high radio frequencies (hereinafter referred to as "RF") these materials lose most of their high magnetic permeability properties so this simple approach to broadband impedance matching becomes ineffective. Further, these devices are limited at high RF frequencies to applications wherein the minimum impedance is approximately 10 Ω. For these lower impedance applications the small round transformer wires add excessive undesired leakage inductance.

For {RF} impedance matching below 10 Ω, another type of impedance matching device is necessary. Impedance matching is necessary, for example, for wireless communication systems where it is desired to impedance match a low impedance power amplifier to a high impedance antenna, wherein the impedance of the power amplifier can be 3.125 Ω and the impedance of the antenna is typically 50 Ω (i.e. 16:1 transformer). The load impedance of a power amplifier in a transmitter output stage is adjusted to match with the input impedance of an antenna to achieve maximum efficiency of the transmitter output stage (ratio of the power fed to the antenna to the overall power used). The applications call for power amplifiers with high output power operating at low DC power supply voltages. This leads to power amplifiers that operate into a load of a few ohms. If the impedance of the power amplifier is not matched with the impedance of the load device while supplying a high-frequency power, then the RF power efficiency is low.

With the progress of electronic and communication technologies, the consumers of electronic communication products demand higher quality services and, in particular, desire to be provided with various services by a single product. To accede to this demand, various electronic circuits having different characteristics have come to be provided in a single communication product. Accordingly, there is a demand for an impedance matching circuit capable of matching impedances at multiple frequencies. Conventional power amplifiers provide the impedance matching capability in a narrowband way that is incapable of simultaneously operating at the desired multiple frequencies.

Without some form of broadband impedance matching network, multi-band radios would require a multiplicity of narrow, single band RF power amplifiers, which utilize narrow band impedance matching circuits. Because multi-band radios use multiple RF power amplifiers, they are typically large in size and expensive to fabricate. In addition to performing the impedance matching function, the power amplifier output network commonly must also perform a direct current (hereinafter referred to as "DC") bias network function. The DC bias network function requires that DC power from an external DC power supply be connected to the amplifier's output transistor while simultaneously connecting the RF output of the transistor to and through the impedance matching network so that the RF but not the DC reaches the external RF load. The DC bias function of a single band power amplifier typically requires a large shunt inductor to stop the RF signal while passing the DC bias current to a large bypass capacitor to ground whose low RF impedance reduces the remaining RF voltage leaving primarily DC voltage to carry the DC supply current to the amplifier's DC power supply. Further, a large series capacitor is typically used to stop the power amplifiers DC power supply voltage output from reaching the RF output signal load of the amplifier. The undesired reactive parasites associated with the large shunt inductor and the large series capacitor can further reduce the bandwidth of the associated matching network.

It would be highly advantageous, therefore, to remedy the foregoing and other deficiencies inherent in the prior art.

SUMMARY OF THE INVENTION

To achieve the objects and advantages of the invention, a new and improved broadband impedance matching integrated circuit is disclosed. In the preferred and initial embodiment, the impedance matching integrated circuit is formed within a low temperature co-fired ceramic (hereinafter referred to as "LTCC"). The integrated circuit includes an electrically conductive ground plane with multiple electrically non-conductive dielectric layers. The generalized LTCC circuit function is created with selectively patterned conductors between the dielectric layers. Required between layer conductivity is achieved with vias each consisting of a small conductor filled hole through the dielectric layer. In an electrical circuit the electrical elements or components are directly or indirectly connected to an electrical ground, which by definition is at zero volts. In the initial embodiment, which employs microstrip format construction, the electrical ground becomes a ground plane conductor that covers the bottom surface of the LTCC substrate. In the microstrip format the top surface of the LTCC substrate is ideally open to unlimited space of air or other dielectric. If the stripline format had been used the top surface of the LTCC substrate would also have been covered with a conductor to create a second ground plane. The inventive microstrip circuit embodiment contains a dielectric layer positioned on the ground plane, a DC bias plane positioned on the dielectric layer, and a high permittivity dielectric material layer positioned on the DC bias plane. An auxiliary ground plane is positioned on the high permittivity dielectric material layer, wherein the auxiliary ground plane is electrically isolated to a direct current from the DC bias plane. The auxiliary ground plane is electrically connected to the ground plane through electrically conductive vias. Further, it will be understood that while the DC and auxiliary ground planes are electrically isolated and separate, they are also approximately at the same RF voltage potential. It should be noted that in this specific embodiment the close proximity of the auxiliary ground plane and the ground plane to the DC bias plane combined with the high permittivity dielectric material layer between them creates a large electric capacity between them that shorts the RF voltage on the DC bias plane to the ground plane. Because of this capacity the DC bias plane has a DC bias voltage but little RF voltage and the DC bias plane approximates an RF ground.

A first conductive transmission line with a width is positioned a distance from the auxiliary ground plane and the DC bias plane. A dielectric material layer with a thickness is positioned on the first conductive transmission line. A second conductive transmission line with a width is positioned on the dielectric material layer. The first and second conductive transmission lines are in close enough proximity so that their electromagnetic fields have significant interaction. The first and second conductive transmission lines are interconnected at the ends so that a current is capable of flowing anti-parallel through the first and second conductive transmission lines and wherein the first and second conductive transmission lines behave as an electro magnetically coupled tapped autotransformer. The via, connecting the first and second transmission lines together, becomes the tap of the autotransformer.

Also, the first conductive transmission line is interconnected at one end with conductive vias to the DC bias plane to provide an RF ground path while passing an input DC bias current and to separate the DC bias current from an RF signal. Further, in the preferred embodiment, the DC bias plane is interconnected with the first conductive transmission line with a plurality of conductive vias, which reduce an undesired inductance to the DC bias plane, which also acts as an RF ground.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the following drawings:

FIG. 3 is a magnified view of a plurality of conductive vias with a reduced inductance in accordance with the present invention;

FIG. 4 is a magnified view of a broadband impedance matching device in accordance with the present invention; and FIG. 5 is a plot of the frequency response of a broadband impedance matching integrated circuit in accordance with the present invention.

DETAILED DESCRIPTION OF THE PREFERRED EMBODIMENT

Figure 1:
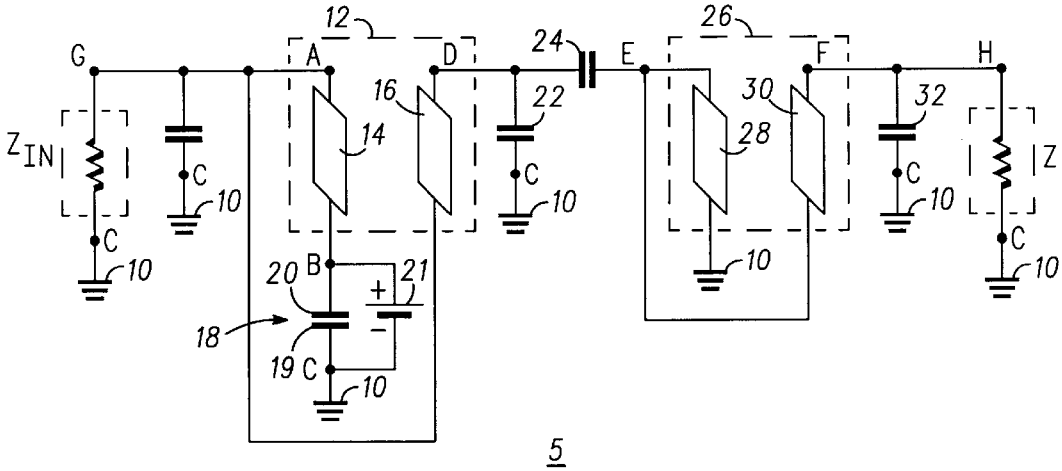
FIG. 1 is a simplified circuit schematic of a broadband impedance matching integrated circuit in accordance with the present invention.

Turn now to FIG. 1, which illustrates a simplified circuit schematic of a broadband impedance matching integrated circuit 5 in accordance with the present invention. The purpose of the circuit schematic shown in FIG. 1 is to illustrate the interconnections of various circuit elements included in integrated circuit 5. Further, electrical nodes in FIG. 1 are labeled A through H to facilitate comparison of the simplified embodiment with the preferred embodiment, as will be discussed separately. Also, in the simplified and preferred embodiments, an integrated circuit with two cascaded electro magnetically coupled tapped autotransformer impedance matching devices is shown, but it will be understood that this is for illustrative purposes only and any number of impedance matching devices may be used to provide a desired impedance match. Further, the simplified and preferred embodiments illustrate a microstrip integrated circuit, however it will be understood that a stripline integrated circuit could be fabricated in a similar manner.

In the simplified embodiment, integrated circuit 5 includes an input impedance, $Z_{in}$, connected to a ground plane 10 wherein $Z_{in}$ is also connected to an impedance matching device 12. $Z_{in}$ is the impedance measured at Node G and is typically the output impedance of a power amplifier (not shown). However, it will be understood that other electronic circuits could be connected to Node G. Device 12 includes a conductive transmission line 14 and a conductive transmission line 16, which are positioned in proximity and coupled to substantially form a transformer (as described in more detail below). Here it should be noted that in one optional embodiment the lower end of transmission line 14 can be connected directly with short conductive vias to the main ground plane (designated 10 in the description below). In the direct ground optional embodiment, a capacitor (capacitor 18 below) is not present and some other circuitry is used for supplying DC power to the power amplifier whose output is connected to the ($Z_{in}$) port.

In the illustrated embodiment a DC bias function is connected for operation. In the DC bias function, transmission line 14 is connected with short conducting vias to a DC bias plane 20, which serves as a top plate of a capacitor 18. Capacitor 18 typically has a large capacitance (i.e. 250 pF) and operates as a bias bypass capacitor to separate the power amplifier's DC power supply voltage from the RF signal of the power amplifier. Capacitor 18 also includes a bottom plate, which in this embodiment is an auxiliary ground plane 19. Auxiliary ground plane 19 and DC bias plane 20 are electrically isolated from each other for a DC bias signal however they are substantially at the same low RF voltage potential. Further, auxiliary ground plane 19 is electrically connected to main ground plane 10, which behaves as both an RF ground and a DC ground.

Here it should be noted that when the DC bias function of integrated circuit 5 is being used, node B or another connection (indicated by terminal 21) to the top of capacitor 18 is connected to the output of a DC power supply designed to supply primary power for the operation of the power amplifier ($Z_{in}$). It is interesting to note that adding the DC bias function (terminal 20) to impedance matching device 12 only requires the addition of the DC bias plane (capacitor 18), which is effectively buried in the ground plane. For purposes of a rough comparison, transmission line 14 of impedance matching device 12 replaces the large shunt inductor required in the narrow single band prior art amplifiers. A capacitor 24, of modest value, helps tune the bandpass of impedance matching device 12 and also stops the DC power supply voltage from reaching the external RF load.

In this simplified embodiment, impedance matching device 12 is connected to a second impedance matching device 26 through a series capacitor 24. A shunt capacitor 22 is included to also help capacitively tune device 12. The function of capacitors 22 and 24 is well known to those skilled in the art and will not be elaborated upon further here. Device 26 includes a conductive transmission line 28 connected to ground plane 10 and a conductive transmission line 30. Device 26 is connected to output impedance, $Z_{out}$, which is electrically connected in parallel with a shunt capacitor 32. Normally the second transformer 26 does not require a DC bias function so it does not have the bias bypass capacitor, like capacitor 18, associated with transformer device 12. Shunt capacitor 32 is used to capacitively tune device 26. $Z_{out}$ is the impedance measured at Node H and is typically the impedance of an output antenna (not shown). However, it will be understood that other electronic components can be interconnected to integrated circuit 5 at Node H.

Impedance matching device 12 operates by electrically connecting the end at Node A of transmission line 14 to the end at Node A of transmission line 16 to form a tapped inductor that behaves as a magnetically coupled autotransformer. In the preferred physical embodiment, conductor lines 114 and 116 are on different dielectric layers and are positioned broadside by broadside in close proximity for broadside coupling.

The schematic can only approximate the real physical circuit. If the schematic components are physically small the physical conductor length associated with the schematic line may be short enough to be a good zero length approximation. The straight transmission line pair [14 and 16] shown in the schematic is too physically long for the short approximation but the invention makes the Node A to Node A connection physically short by bending the side by side 14 and 16 conductors in an almost closed geometry so that the opposite ends are essentially adjacent. When this is done the physically short via replaces the apparently long schematic connection. This innovative bending is very important to the realization of the transformer.

The magnetically coupled tapped autotransformer depends on mutual inductance for is operation. The side-by-side 14 and 16 conductors/transmission lines provide the required mutual inductance. If the currents in the side-by-side 14 and 16 conductors are moving in the same direction most of the magnetic flux that results from these two side-by-side currents will encircle both conductors. If two symmetric conductors are connected together so that their currents and voltages are equal and in phase, they can be considered to be operating in common or even mode. To the extent, that both conductors share the same magnetic flux, a common mutual flux that is magnetically linked to both conductors results in a mutual inductance between the two conductors. The mutual magnetic flux that is external to both conductors reaches out either to infinity or to the ground plane. The proximity of the ground plane or the electrically conductive housing terminates the magnetic flux and limits the value of the mutual inductance. High values of mutual inductance creates an impedance that resists the undesired flow of the even mode RF current. Stopping the undesired even mode current flow while permitting the desired odd mode current to flow makes magnetically coupled transformers work. For proper transformer operation the impedance of the mutual inductance at the operating frequency must be high compared to the load and/or source impedance of the transformer. The impedance of an inductor is always zero at zero frequency (i.e., DC) so magnetically coupled transformers do not transform at DC. Increasing the length of the coupled conductors increases the desired mutual inductance but the increased length also increases the undesired parasitic reactances. At relatively low frequencies, special high magnetic permeability materials are available that greatly increase the strength of the magnetic flux. Conventional low frequency transformers contain high permeability magnetic materials in properly shaped magnetic cores that greatly increase the value of desired mutual inductance without increasing the undesired parasitic leakage inductance. Broadband RF impedance transformation requires a new design approach that does not require high permeability magnetic materials.

Making the conductors (e.g. transmission lines 14/16 and/or 28/30) longer and/or smaller and/or closer together and/or farther away from the ground plane can increase the mutual inductance of the side-by-side conductor pair. A high and/or adequate value of mutual inductance is essential for the impedance transforming operation of a magnetically coupled transformer. The side-by-side or common or even mode parallel currents model is used to calculate the mutual inductance but in a properly operating semi ideal transformer the frequency dependent reactive impedance of the mutual inductance is so high that insignificant parallel or common mode current flows. This is the desired result. Insignificant current flow is not zero but the common or even mode current flow should be small compared to the external load and source currents. At a lower frequency where the reactance of the mutual inductance is inadequate the parallel or common or even mode current becomes excessive and the transformer loses its transforming power. If the currents of side-by-side transmission lines 14 and 16 flow in opposite or odd mode directions they do not excite the mutual inductance and experience no reactive impedance. By definition the odd mode currents are equal in magnitude and flow in opposite directions.

The high mutual inductance induced impedance experienced by the side-by-side parallel currents resists the in-phase even mode parallel currents but equal and anti-phase or odd mode currents can flow unimpeded in the side-by-side conductor pair. The equal but opposite direction odd mode current flows experience no inductive impedance because the opposing currents cancel the external magnetic flux and do not excite the high mutual inductance impedance. The ideal inductor, individual or mutual, is a reactive element that can absorb no power. Referring again to FIG. 1, a magnetically coupled transformer (impedance matching device 12) includes two side-by-side conductors (transmission lines 14 and 16) that are positioned parallel and close so that they have substantial mutual inductance. An RF voltage at node A induces a current from node A through line 14 either directly to ground or through low impedance DC Bias capacitor 18 to ground. The same RF voltage that is at node A induces an equal but anti-parallel or odd mode current from node A through line 16 to the output node D. The currents being equal and anti-parallel odd mode experience no reactive impedance from the mutual inductance. The RF load impedance at node D determines the autotransformer input impedance seen at node A and ideally all the power flowing into node A appears at node D. Since the high value of mutual inductance stops the even mode currents and forces the equality of the odd mode currents in the two conductors (lines 14 and 16) currents must be equal and the currents flowing out of node D and node B are half the current flowing out of node G and into node A. Power must be conserved in this reactive device so the node D output with half the current must have twice the input voltage at node A. This essentially defines a 2:1 voltage ratio and 4:1 impedance ratio transformer. The limited value mutual inductance acts like a conventional inductor in shunt across the input or output of an ideal transformer. This shunt inductor shorts out the low frequency signals and limits the low frequency passband of the non ideal transformer. The lower the operating impedance of the transformer the lower the value of required mutual inductance. The LTCC type of construction is best suited for low impedance transformers.

In this invention capacitive tuning is employed at the input and output of the transmission line transformer to improve the bandwidth. The capacitive tuning turns the marginal transmission line autotransformer into an impedance transforming bandpass filter with a very good passband over a limited band. All real transformers are band limited either by inadequate mutual inductance or by excessive undesired reactances. Side-by-side transmission lines 14/16 and/or 28/30 in addition to the desired mutual inductance created by the magnetic flux that circles or encloses both conductors have other undesired reactances that can limit the upper frequency range of the transformer. One such undesired reactance is the length distributed leakage inductance that is caused by the magnetic flux that passes between the two conductors. This leakage flux is not mutual and does not contribute to the desired mutual inductance. The impedance caused by the leakage inductance impedes the flow of the desired transformer current. It can be approximated as a lumped inductor in series with the input or output of the more ideal mutual inductance only transformer. The leakage inductance limits the high frequency performance of the transformer. Moving the conductors closer together reduces the leakage inductance by leaving less room for the undesired magnetic field leakage flux to squeeze through.

The relative importance of the leakage inductance $L_s$ and shunt capacity $C_{sh}$ depends on the operating impedance of the transformer. The transformer lumped element model incorporating an ideal transformer, with shunt mutual inductance, the undesired series leakage inductance and the undesired shunt capacity at its input or output can only approximate a real transformer, which is significantly distributed in nature. The simple model is more appropriate for a conventional magnetic core transformer where the low frequency pass band limit determined by $L_m$ is far below the high frequency limit determined by $L_s$ and $C_{sh}$. It also makes it easier to understand the transformer frequency response problem. Circuits like the present invention call for a more accurate distributed transmission line circuit model.

An accurate solution of the transmission line transformer requires a distributed transmission line calculation. The series inductance and shunt capacity per unit length of the TEM line determine its impedance and propagation velocity. The per unit length inductance and capacity of the transmission line are defined by the physical dimensions of the conductors and by the properties of the dielectric surrounding the conductors. The impedance is determined by the ratio of series inductance to shunt capacity. The propagation velocity is determined by the square root of the reciprocal product of the per unit length series inductance and shunt capacity.

The transmission line pair is more complex but a symmetric pair with uniform dielectric material can be defined in terms of even and odd mode impedances and propagation velocity. The series inductance and shunt capacity values depend on the operating mode. In the even mode both conductors are assumed to operate at the same voltage with equal in phase currents. In the odd mode the conductors are at opposite voltages with equal anti-phase currents. The actual circuit operation may have a combination of even and odd mode currents but the combination problem can be solved using both the even and odd mode characteristics. The series inductance and shunt capacity per unit length are calculated to determine the line impedance and propagation velocity for each mode. The series inductance of the even mode impedance is most of the desired and required mutual inductance of the transformer. High even mode impedance is desirable. Making the conductors smaller in cross section and further from the ground plane increases the even order impedance. The series inductance and shunt capacity of the odd mode impedance is the primary contributor to the undesired leakage inductance and shunt capacity that limits the transformer's high frequency response. The odd mode impedance is strongly influenced by the spacing between the two conductors. There is an optimum value for the odd mode impedance that depends substantially on the operating impedance of the transformer. The shunt capacity of the even mode impedance is also detrimental but it is usually less significant.

With some simplifying assumptions of symmetry and uniform dielectric material the stripline transmission line transformer problem can be solved with available commercial computer programs. FIG. 5 shows the results of an ADS1.5 calculation for some reasonable even and odd mode stripline impedance assumptions. A symmetric stripline format transmission line pair with two ground planes, and two symmetrically centered broadside-coupled parallel conductors with uniform dielectric constant insulating material, can meet these assumptions. A more difficult to calculate microstrip format can achieve a functional equivalent. The advantage of the stripline assumptions is that the closed form calculations are much faster and permit the circuit impedances and lengths to be optimized. The optimized calculation is for a cascade of two non-identical transmission line transformers with an overall 16:1 [Zin=3.128 to Zout=50 ohms] impedance ratio. The optimized circuit contains capacitors to tune the imperfect transformers for a very good passband over the 0.8 GHz to 2.5 GHz frequency band. Increasing the even mode impedance increases the desired and essential mutual inductance without limit so this value was not optimized but fixed at 100 ohms by substrate thickness practicalities. Without limiting the even order impedance the optimizer would calculate a very wideband but un-buildable transformer. The even mode impedance is primarily limited by the dielectric constant and thickness of the substrate. For this tightly coupled transmission line pair, the spacing between the broadside coupled lines primarily controls the odd mode impedance and has very little control over the even mode impedance. For this reason it was reasonable to fix the even mode impedance while optimizing the odd mode impedance.

The individual transformers had the odd order impedances, electrical lengths of their transmission lines and associated capacitor values, optimized for a −30 dB or better S11 return loss over the 0.8 GHz to 2.5 GHz frequency band for the full two auto-transformer FIG. 1 circuit. Transformer 12 had Zeven=4.6 ohms and an electrical length of 22.7 degrees at 1.326 GHz. Transformer 26 had Zeven=30.6 ohms and an electrical length of 30.6 degrees at 1.326 GHz. The apparently precise values are in fact approximate and depend on passband and substrate assumptions. The coupled transmission lines are electrically short. Additional analysis has shown that when the electrical length becomes a half wavelength the signal transmission S21 goes to zero. This represents an absolute limit for the transformer's coupled line length.

The marginal mutual inductance of the transmission line autotransformers combined with the undesired leakage inductance and shunt capacity would result in a marginal transformer passband. By capacitively tuning the input and output of the imperfect transmission line autotransformers the passband of the complete circuit becomes very good over a limited bandwidth as shown in FIG. 5. The capacitors serve to tune the imperfect transformer to transform the entire impedance-transforming network into a combination of an impedance transformer and a band pass filter. The purpose of the capacitive elements of the band pass filter is to improve the pass band of an imperfect transformer. The rejection band of the band pass filter may have some application benefits but it is not the primary function of the band pass filter. The capacitive tuning creates a good pass band from what would otherwise be a mediocre or inadequate pass band. Some of the initial optimized capacitors essentially disappeared as their value approached zero. These capacitors do not appear in FIG. 1 nor were they implemented in an actual experimental circuit. In keeping with the previous simplified analysis, which showed that the idealized coupled line, autotransformer approximates a 4:1 impedance ratio the two-cascaded transformers were optimized to deliver a 16:1 overall impedance transformation ratio (e.g., 3.125 ohms to 50 ohms).

Capacitor 18 is large [244 pF] and is primarily intended for the proper operation of the DC bias circuit.

Figure 2:
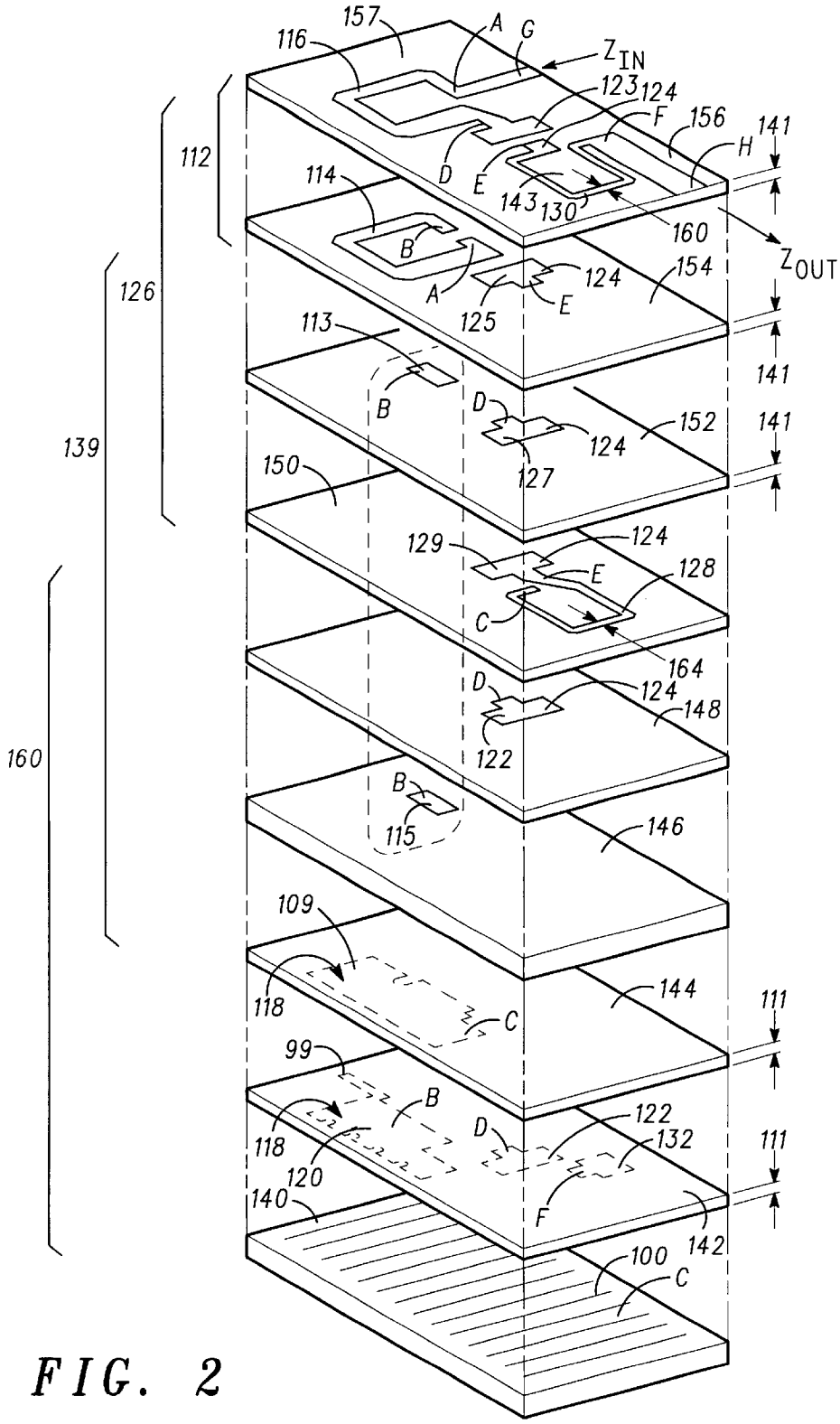
FIG. 2 is an exploded view of a broadband impedance matching integrated circuit in accordance with the present invention.

The purpose of FIG. 2 is to show how integrated circuit 5 is fabricated within a multi-layer low temperature co-fired ceramic (hereinafter referred to as "LTCC"). As discussed previously, Nodes A through H labeled in FIG. 1 are also labeled in FIG. 2 to facilitate comparison between the circuit elements in the simplified embodiment and the preferred embodiment wherein the various nodes in FIG. 2 are interconnected through horizontal conductor patterns and vertical conductive vias (not shown), as will be discussed presently. In the FIG. 2 illustration the bottom layer 140 is fully conductive to form the main 100 substrate ground plane. The multiple ceramic dielectric layers are located horizontally above the main ground plane. The named or numbered dielectric will be described as being on top of or "thereon" a lower dielectric layer. The lower dielectric layer may have localized conductive patterns on its top surface but the upper dielectric layer will still be on top of "thereon" the lower dielectric layer.

The impedance matching integrated circuit illustrated in FIG. 1 is formed compactly in a preferred microstrip embodiment, as illustrated in FIG. 2, wherein an exploded view of a broadband impedance matching integrated circuit 105 with a low impedance Zin input at node G two autotransformers 157 [with lines 114 and 116] and 143 [with lines 130 and 128], several fixed value tuning capacitors 124 122 132, and connections employing single level horizontal conductors and vertical via conductors. The DC bias bypass capacitor 18 is created with DC bias plane conductor 120 an auxiliary ground plane [19=conductor pattern 100] and the main substrate ground plane [10=conductor pattern 100]. The high impedance Zout connection at node H conductor is on the top surface of the top 156 dielectric as is the node G Zin connection.

Integrated circuit 105 includes a ground plane 100 onto which a LTCC layer 142 with a thickness 111 is positioned. A large substrate bottom ground plane 100 is used in this embodiment as a common connection area for the multiple main ground plane 10 connections (illustrated in FIG. 1). A DC bias plane 120 is positioned on layer 142 and a high permittivity dielectric material layer 144 with a thickness 111 is positioned on layer 142 wherein an auxiliary ground plane 109 is positioned thereon. Thus, auxiliary ground plane 109 is spaced apart from DC bias plane 120 by layer 144. It will be understood that high permittivity dielectric material layer 144 can include a high permittivity dielectric paste, another suitable high permittivity material, or combinations thereof.

Auxiliary ground plane 109 and DC bias plane 120 behave as two plates of a capacitor 118 (corresponding to capacitor 18 in FIG. 1) which are separated by high permittivity dielectric material layer 144 wherein auxiliary ground plane 109 and DC bias plane 120 are substantially at an equal RF potential. Auxiliary ground plane 109 is electrically connected to the main ground plane 100 by multiple vias on its periphery located so they reach the main ground plane 100 without electrically contacting the DC bias plane 120 which is under the auxiliary ground plane 109. Thus, DC bias plane 120 is capable of separating out a DC bias signal from Node G and is capable of allowing a RF signal current to pass through to auxiliary ground plane 109 (and ground plane 100). As a result, auxiliary ground plane 109 is electrically isolated to a direct current from DC bias plane 120. Further, a lead 99 is electrically connected to DC bias plane 120 and acts as a DC current path to an external DC bias power supply.

In the preferred embodiment, a top capacitor plate 122 and a top capacitor plate 132 are also positioned on layer 142 wherein a corresponding bottom capacitor plate is ground plane 100. Top capacitor plate 122 corresponds to a plate included in capacitor 22 of FIG. 1 connected to Node D. Further, top capacitor plate 132 corresponds to a plate included in capacitor 32 of FIG. 1 connected to Node F (or equivalently Node H). The ceramic material of layer 142 provides the dielectric material for the capacitor function. Capacitors 122 and 132 have values chosen to capacitively tune impedance matching microstrip integrated circuit 105 for the desired bandwidth.

A LTCC ceramic layer 146 is positioned thereon layer 144. Layer 146 includes a conductive plate 115 which will be discussed separately. A LTCC layer 148 is positioned on layer 146 whereon a portion of a multi-layer capacitor 124 is positioned thereon. Capacitor 124 corresponds to capacitor 24 of FIG. 1 wherein in the preferred embodiment, capacitor 124 includes multiple metal layers separated by LTCC layers, as will be discussed presently. The portion of capacitor 124 formed thereon layer 148 includes a top metal plate 121.

A LTCC layer 150 is positioned on layer 148 whereon a portion of an impedance matching device 126 is positioned. The portion of device 126 positioned on layer 148 and 150 includes a conductive transmission line 128 with a width 164 and an end. Also positioned on layer 150 is a bottom metal plate 129, which is another portion of capacitor 124.

A LTCC layer 152 is positioned on layer 150 wherein a metal layer 113 is positioned thereon. Metal layer 113, Node B, is connected to metal layer 115, Node BB, through at least one electrically conductive via. The vertical conductive via path from 113 to 115 is part of the conductive via connection of node B of line 114 to node B located on the DC bias Plane 120. Node B of line 114 is electrically connected to the effective RF ground of the DC bias plane 120. The initial via connection from node B on line 114 has two vias through the 154 layer to the 113 conductive area on the top surface of layer 152. Multiple electrically parallel vias connect through several layers to conductive area 115 on the top of layer 146. In this preferred embodiment, four electrically conductive vias are used, as shown in FIG. 3, to increase the bandwidth by reducing the inductance of the ground connection. It will be understood that the use of four vias in this embodiment is for illustrative purposes only and that more or less vias may be used as desired. FIG. 3 illustrates an enlarged view of a region 151 shown in FIG. 2 wherein region 151 includes metal plates 113 and 115.

Conductive vias 162, 163, 164, and 165 are formed thereon-metal plate 115 and are electrically connected to metal plate 113. Vias 162, 163, 164, and 165 are electrically isolated from each other except at metal plates 113 and 115. The ground path connection is completed by two parallel vias from 115 through dielectric substrate layer 146, through a clearance notch in the auxiliary ground plane 109, and through dielectric substrate layer 144 to connect to the DC bias plane conductor 120 at Node B. Node B on DC bias plane conductor 120 is effectively an RF ground. Physical connection room and other considerations limits the number of vias at the ends but increasing the number of parallel vias in the less crowded middle region reduces the undesired ground inductance.

Turning back to FIG. 2, a top metal plate 127, which corresponds to another portion of capacitor 124, is positioned on layer 152. A LTCC layer 154 is positioned on layer 152 wherein a portion of an impedance matching device 112 is positioned thereon. The portion of device 112 positioned on layer 152 includes a conductive transmission line 114 with a width 163 and an end. A bottom metal plate 125 is also positioned on layer 154 wherein plate 125 forms a portion of multi-layer capacitor 124.

A LTCC layer 156 with a thickness 141 is positioned on layer 154 wherein layer 156 includes a portion of impedance matching device 112. The portion of device 112 positioned on layer 156 includes a conductive transmission line 116 with a width 161 and an end. A top metal plate 123 is also positioned on layer 156 and forms a portion of multi-layer capacitor 124. Also positioned on layer 156 is a portion of impedance matching device 126. The portion of device 126 positioned on layer 156 includes a conductive transmission line 130 with a width 162 and an end, wherein conductive transmission lines 130 and 128 are separated by a thickness 143 of LTCC layers 152, 154, and 156. Node E on line 128 is connected through LTCC layers 152, 154, and 156 to node E on line 130. Node E is the low impedance input tap of tapped autotransformer device 126. The combined thickness 143 of LTCC layers 152, 154, and 156 is chosen to optimize the odd mode impedance of the coupled transmission line tapped auto-transformer device 126.

Impedance matching device 112 operates by electrically connecting the end at Node A of transmission line 114 with a vertical conducting via to the end at Node A of transmission line 116 to form a tapped inductor that behaves as a magnetically coupled autotransformer. In the preferred embodiment, Node A is formed with an electrically conductive via. The mutual inductance substantially depends on widths 163 and 161 of lines 114 and 116, respectively, and distance 141. The distance 141 strongly influences the odd mode impedance of line pair 114 and 116. Node B is electrically connected through vertical conducting vias to DC bias plane 120 which is almost at the same RF potential bias as ground plane 100 and auxiliary ground plane 109. Further, Node A forms a low impedance connection to impedance matching device 112 and Node D forms a high impedance connection. In the preferred embodiment, the impedance at Node D is approximately a factor of four greater then the impedance at Node A over a frequency range of approximately 0.8 GHz to 2.2 GHz.

Impedance matching device 126 operates in a similar manner to device 112 wherein transmission lines 128 and 130 are interconnected with vertical conducting vias at Node E to form a tapped inductor that behaves as a magnetically coupled autotransformer. Node C at one end of line 128 is conducted with vertical conducting vias to ground plane 100. The higher operating impedance of autotransformer device 126 is more tolerant of inductance in the ground connection via so this embodiment does not use multiple parallel vias for this connection. In device 126, Node E behaves as a low impedance connection and Node F behaves as a high impedance connection wherein the impedance at Node F is approximately a factor of four different than at Node E. Consequently, the impedance at Node F is approximately a factor of sixteen different than the impedance at Node A. For example, if the impedance at Node A is 3.125 Ω, then the impedance at Node F will be approximately 50 Ω.

Turn now to FIG. 4 which illustrates a greatly enlarged view of a region 157 shown in FIG. 2 which includes impedance matching device 112 with an output impedance, $Z_{out}$, and a current, I.

Turn now to FIG. 5 that illustrates a plot 170 of a simulated frequency response of broadband impedance matching integrated circuit 105. The simulation is for a $Z_{in}$=3.125 Ω to $Z_{out}$=50 Ω impedance transformation (16:1) over the frequency range from 0.8 GHz to 2.4 GHz. As illustrated in plot 170, a return loss of less than −30 dB is achieved over the desired frequency range indicating the desired impedance matching.

Thus, broadband impedance matching integrated circuit 105 behaves like a broadband impedance transformer in which the bandwidth has been significantly increased by reducing the shunt inductance to DC ground. Also, integrated circuit 105 provides improved impedance matching at low resistances (to approximately 3 Ω) typically needed for power amplifiers wherein a 16:1 impedance transformation ratio is achieved. Further, integrated circuit 105 with a built in DC bias network eliminates the need for a separate large shunt inductor, large shunt capacitor and large series capacitor to perform the DC bias function separate from and in addition to the conventional output impedance matching network thereby reducing the package size and cost.

This invention describes a very basic device which is new but simple in its conceptual design. Creating a new RF transformer without requiring the essentially unavailable high RF permeability magnetic material can solve very real application problems. The conventional and very common wire wound transformers need the high permeability magnetic material to work. The wire wound format has other problems at low impedances. Basically the small round wire format tends to create a high impedance transmission line and is not suited at RF for the low impedances at which the new invention can operate. The wide thin closely spaced conductors in LTCC construction can operate at low impedances. The almost closed shape of the coupled transmission lines greatly reduces the undesired leakage inductance associated with the circuit connections. The new design solves three RF transformer problems 1:The magnetic material problem. 2:The low impedance problem 3:The bandwidth problem. There are other ways of obtaining good bandwidth in RF impedance transformers but they are bulky and or complex. The simpler RF impedance transforming circuits are narrowband.

The initial physical design was built with essentially standard low cost LTCC techniques. A high dielectric constant Er=90 paste was used for layer 144 to increase the value of the bias bypass capacitor. The smaller value tuning capacitors were easily built in the Er=7.8 material.

The original implementation of the invention shown in FIG. 2 claimed as a benefit that good performance was obtained without the use of high permeability magnetic material and this very desirable economic and performance feature is true.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. A broadband impedance matching integrated circuit apparatus with a mutual inductance, the apparatus comprising:

a first conductive transmission line with a first end, a second end, a width, and a surface, the first end of the first conductive transmission line has an input impedance and the second end of the first conductive transmission line has an output impedance;

a dielectric material layer with a thickness positioned on the first conductive transmission line;

a second conductive transmission line with a first end, a second end, a width, and a surface, the second conductive transmission line positioned on the dielectric material layer wherein the first end of the second conductive transmission line is electrically connected to the second end of the first conductive transmission line so that a current is capable of flowing anti-parallel through the first and second conductive transmission lines;

wherein the first end of the second conductive transmission line has an input impedance and the second end of the second conductive transmission line has an output impedance; and wherein the first and the second conductive transmission lines behave as an electromagnetically coupled tapped autotransformer.

2. An apparatus as claimed in claim 1 wherein the second end of the first conductive transmission line is electrically connected to the first end of the second conductive transmission line through an electrically conductive via.

3. An apparatus as claimed in claim 1 wherein the mutual inductance is substantially determined by the thickness of the dielectric material layer.

4. An apparatus as claimed in claim 1 including in addition a plurality of broadband impedance matching integrated circuits electrically connected in series, wherein each broadband impedance matching integrated circuit is electrically connected in series through at least one capacitor.

5. An apparatus as claimed in claim 4 wherein the capacitor has a value chosen to capacitively tune the broadband impedance matching integrated circuit.

6. An apparatus as claimed in claim 1 wherein the broadband impedance matching integrated circuit is formed within a low temperature co-fired ceramic.

7. An apparatus as claimed in claim 1 wherein the input impedance is approximately a factor of four different than the output impedance.

8. An apparatus as claimed in claim 1 wherein the first end of the first conductive transmission line is electrically connected to a ground plane through at least one electrically conductive via.

9. An apparatus as claimed in claim 1 wherein the surface of the first conductive transmission line is oriented approximately parallel with the surface of the second conductive transmission line.

10. A broadband impedance matching integrated circuit apparatus with a mutual inductance, and a bandwidth, the apparatus comprising:

a ground plane;

a high permittivity dielectric material positioned on the ground plane;

a direct current bias plane positioned on the high permittivity dielectric material, the direct current bias plane being electrically isolated to a direct current from the ground plane;

a first conductive transmission line with a surface, a first end, a second end, and a width, the first conductive transmission line positioned a distance from the direct current bias plane wherein the first end of the first conductive transmission line is electrically connected to the direct current bias plane through at least one electrically conductive via;

a second dielectric material layer with a thickness positioned on the first conductive transmission line;

a second conductive transmission line with a surface, a first end, a second end, and a width, the second conductive transmission line positioned on the second dielectric material layer wherein the first end of the second conductive transmission line is electrically connected to the second end of the first conductive transmission line so that a current is capable of flowing anti-parallel through the first and second conductive transmission lines;

wherein the first end of the second conductive transmission line has an input impedance and the second end of the second conductive transmission line has an output impedance;

wherein the surface of the first conductive transmission line is oriented approximately parallel with the surface of the second conductive transmission line;

wherein the broadband impedance matching integrated circuit apparatus is formed within a low temperature cofired ceramic; and wherein the first and second conductive transmission lines behave as an electromagnetically coupled tapped autotransformer.

11. An apparatus as claimed in claim 10 wherein the second end of the first conductive transmission line is electrically connected to the first end of the second conductive transmission line through an electrically conductive via.

12. An apparatus as claimed in claim 10 wherein the mutual inductance is substantially determined by the thickness of the second dielectric material.

13. An apparatus as claimed in claim 10 wherein the second dielectric material layer includes a low temperature co-fired ceramic.

14. An apparatus as claimed in claim 10 including in addition a plurality of broadband impedance matching integrated circuits electrically connected in series, wherein each broadband impedance matching integrated circuit is electrically connected in series through at least one capacitor.

15. An apparatus as claimed in claim 14 wherein the capacitor has a value chosen to capacitively tune the broadband impedance matching integrated circuit.

16. An apparatus as claimed in claim 10 wherein the input impedance is approximately a factor of four different than the output impedance.

17. An apparatus as claimed in claim 10 wherein an even mode impedance substantially depends on the distance between the first conductive transmission line and the direct current bias plane.

18. An apparatus as claimed in claim 10 wherein an odd mode impedance substantially depends on at least one of the width of the first and second conductive transmission lines and the thickness of the second dielectric material layer.

19. An apparatus as claimed in claim 10 wherein the bandwidth is substantially determined by the distance of the first conductive transmission line from the direct current bias plane.

20. An apparatus as claimed in claim 10 wherein an even mode impedance substantially depends on the distance between the first conductive transmission line and the ground plane.

21. An apparatus as claimed in claim 10 wherein an odd mode impedance substantially depends on at least one of the width of the first and second conductive transmission lines and the thickness of the dielectric material layer.

22. A broadband impedance matching integrated circuit apparatus with a mutual inductance, and a bandwidth, the apparatus comprising:

a ground plane;

a first dielectric layer positioned on the round plane;

a direct current bias plane positioned on the first dielectric layer;

a high permittivity dielectric material layer positioned on the direct current bias plane;

an alternating current bias plane positioned on the high permittivity dielectric material layer wherein the alternating current bias plane is electrically connected to the ground plane, the alternating current bias plane being electrically isolated to a direct current from the direct current bias plane;

a first conductive transmission line with a first end, a second end, and a width, the first conductive transmission line positioned a distance from the direct current bias plane, wherein the first end of the first conductive transmission line is electrically connected to the direct current bias plane through at least one electrically conductive via;

a second dielectric material layer with a thickness positioned on the first conductive transmission line;

a second conductive transmission line with a first end, a second end, and a width, the second conductive transmission line positioned on the second dielectric material layer wherein the first end of the second conductive transmission line is electrically connected to the second end of the first conductive transmission line so that a current is capable of flowing anti-parallel through the first and second conductive transmission lines;

wherein the first end of the second conductive transmission line has an input impedance and the second end of the second conductive transmission line has an output impedance;

wherein the surface of the first conductive transmission line is oriented approximately parallel with the surface of the second conductive transmission line;

wherein the broadband impedance matching integrated circuit apparatus is formed within a low temperature cofired ceramic; and wherein the first and second conductive transmission lines behave as an electromagnetically coupled tapped autotransformer.

23. An apparatus as claimed in claim 22 wherein the second end of the first conductive transmission line is electrically connected to the first end of the second conductive transmission line through an electrically conductive via.

24. An apparatus as claimed in claim 22 wherein the mutual inductance is substantially determined by the thickness of the second dielectric material.

25. An apparatus as claimed in claim 22 wherein the second dielectric material layer includes a low temperature co-fired ceramic.

26. An apparatus as claimed in claim 22 including in addition a plurality of broadband impedance matching integrated circuits electrically connected in series, wherein each broadband impedance matching integrated circuit is electrically connected in series through at least one capacitor.

27. An apparatus as claimed in claim 26 wherein the capacitor has a value chosen to capacitively tune the broadband impedance matching integrated circuit.

28. An apparatus as claimed in claim 22 wherein the input impedance is approximately a factor of four different than the output impedance.

29. An apparatus as claimed in claim 22 wherein the even mode impedance substantially depends on the distance between the first conductive transmission line and the direct current bias plane.

30. An apparatus as claimed in claim 22 wherein the odd mode impedance substantially depends on at least one of the width of the first and second conductive transmission lines and the thickness of the second dielectric material layer.

31. An apparatus as claimed in claim 22 wherein the bandwidth is substantially determined by the distance of the first conductive transmission line from the direct current bias plane.

32. A broadband impedance matching integrated circuit apparatus comprising:

a first transmission line having a first end and a second end with the first end operating as a current input;

a second transmission line having a first end and a second end, the second transmission line being positioned adjacent the first transmission line to provide mutual inductance therebetween, and the second end of the second transmission line operating as a current output;

a connection between the second end of the first transmission line and the first end of the second transmission line;

the first transmission line and the second transmission line each having a closed shape so that the connection is a minimum length;

the second end of the first transmission line being connected as a current return for current at the current input; and the first transmission line and the second transmission line having approximately equal lengths positioned adjacent each other so that current flowing in the second transmission line is substantially one half current flowing in the first transmission line and in an opposite direction to provide a substantially 4:1 impedance ratio transformer.

33. A broadband impedance matching integrated circuit apparatus as claimed in claim 32 including a laminated ceramic body with the first transmission line formed on one lamination and the second transmission line formed on an adjacent lamination.

34. A broadband impedance matching integrated circuit apparatus as claimed in claim 33 wherein the connection is a via between the lamination and the adjacent lamination.

35. A broadband impedance matching integrated circuit apparatus as claimed in claim 32 including a plurality of cascaded substantially 4:1 impedance ratio transformers to provide a greater than substantially 4:1 impedance ratio transformer.

* * * * *